US005713273A

United States Patent [19]

Lai

[11] Patent Number: 5,713,273

[45] Date of Patent: Feb. 3, 1998

[54] HOT PRESS MECHANISM FOR PRINTING MACHINE

[76] Inventor: Chih-min Lai, No. 32, Alley 6, Mei Man East 3 Lane, Hsi Tun Zone, Taichung, Taiwan

[21] Appl. No.: 814,531

[22] Filed: Mar. 10, 1997

[51] Int. Cl.[6] ..... B44B 5/00

[52] U.S. Cl. ..... 101/9; 101/25

[58] Field of Search ..... 101/9, 21, 31, 101/25, 8, 23, 22, 27

[56] References Cited

U.S. PATENT DOCUMENTS

| | | | |
|---|---|---|---|
| 3,097,592 | 7/1963 | Friedman | 101/8 |
| 3,294,014 | 12/1966 | Kneisel | 101/25 |
| 4,007,767 | 2/1977 | Colledge | 101/25 |
| 4,599,128 | 7/1986 | Held | 156/322 |
| 4,928,588 | 5/1990 | Mathis | 101/9 |
| 5,069,122 | 12/1991 | Kaufmann et al. | 101/9 |

FOREIGN PATENT DOCUMENTS

| | | | |
|---|---|---|---|
| 55-39303 | 3/1980 | Japan | 101/9 |
| 896961 | 5/1962 | United Kingdom | 101/25 |

*Primary Examiner*—Edgar S. Burr
*Assistant Examiner*—Anthony H. Nguyen
*Attorney, Agent, or Firm*—Charles E. Baxley, Esq.

[57] ABSTRACT

A hot press mechanism for a printing machine includes a roller having a longitudinal channel and a peripheral chamber formed in the peripheral portion. A mold piece is secured on the peripheral portion of the roller for engaging with a sheet material to be printed. A heating plate is engaged in the peripheral chamber of the roller for heating the mold piece, and a heat insulating layer is engaged between the roller and the heating plate for preventing the roller from being heated. Only the mold piece is heated for allowing much electric energy to be saved.

2 Claims, 3 Drawing Sheets

HOT PRESS MECHANISM FOR PRINTING MACHINE

BACKGROUND OF THE INVENTION

1. Field of the Invention

The present invention relates to a hot press mechanism, and more particularly to a hot press mechanism for a printing machine.

2. Description of the Prior Art

Typical hot press type printing machines comprise a roller for engaging with a sheet member to be printed. The roller is heated and has a pattern formed on the outer peripheral surface for hot pressing the sheet material and for forming the pattern on the sheet material. However, it takes a long time to heat the whole roller and it wastes a lot of energy for heating the whole roller. In addition, after printing operation, the roller is still hot and is useless such that the energy is further wasted.

The present invention has arisen to mitigate and/or obviate the afore-described disadvantages of the conventional hot pressing type printing machine.

SUMMARY OF THE INVENTION

The primary objective of the present invention is to provide a hot press mechanism for a printing machine in which only the outer peripheral portion of the roller is heated and the interior of the roller may be prevented from being heated.

In accordance with one aspect of the invention, there is provided a hot press mechanism for a printing machine, the hot press mechanism comprises a roller including a peripheral portion, a longitudinal channel formed in the peripheral portion, a peripheral chamber formed in the peripheral portion of the roller and communicating with the longitudinal channel, a mold piece engaged on the peripheral portion of the roller for engaging with a sheet material to be printed, means for securing the mold piece on the roller, a heating plate engaged in the peripheral chamber of the roller for heating the mold piece, the heating plate including an upper and a lower portions, two protective layers engaged on the upper and the lower portions of the heating plate, and a heat insulating layer engaged in the peripheral chamber of the roller and engaged between the roller and the heating plate for preventing the roller from being heated.

The securing means includes a pair of bars secured to the roller for enclosing the peripheral chamber and includes at least one fastener members for securing the mold piece to the roller.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
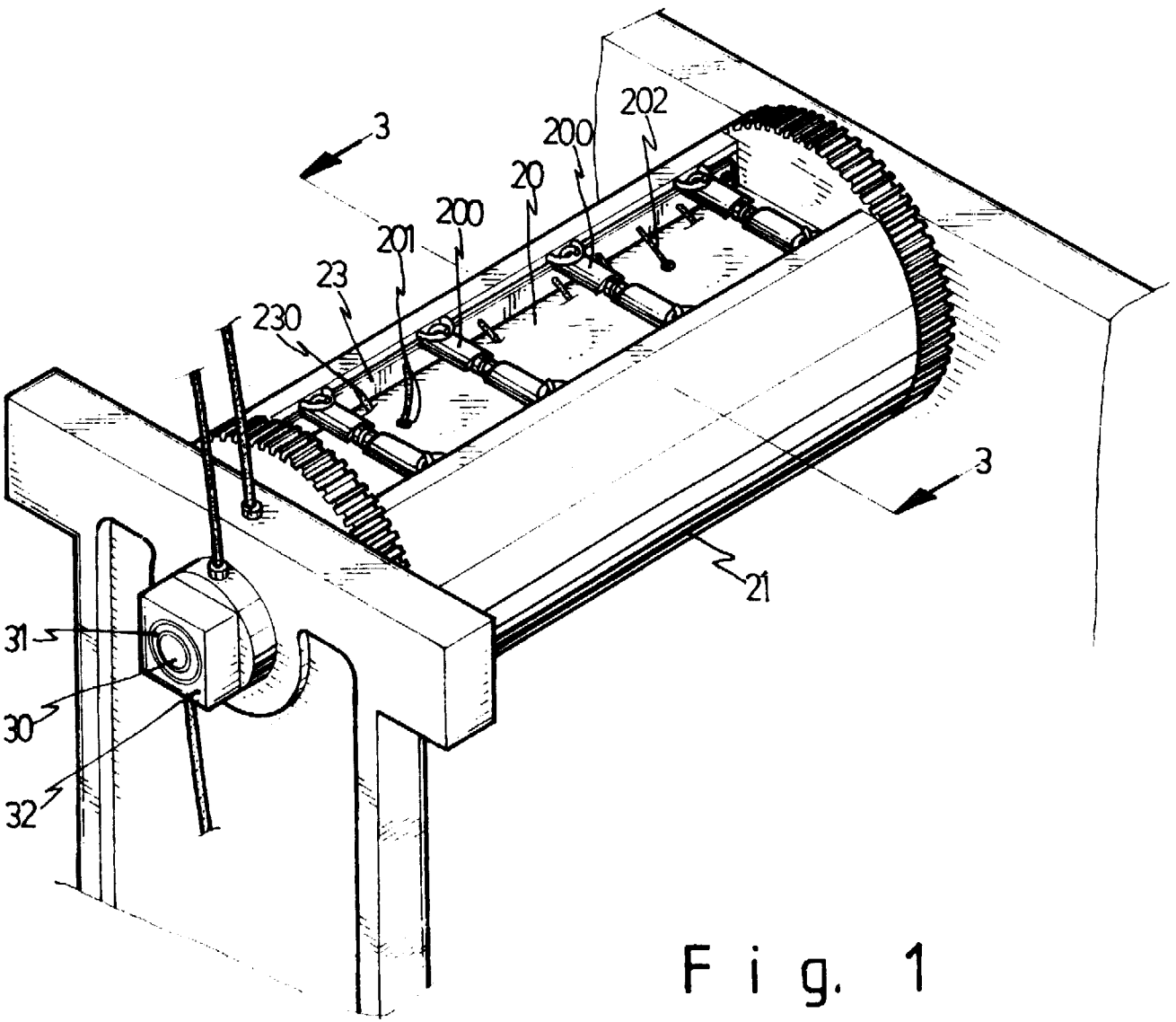
FIG. 1 is a perspective view of a printing machine.
Figure 2:
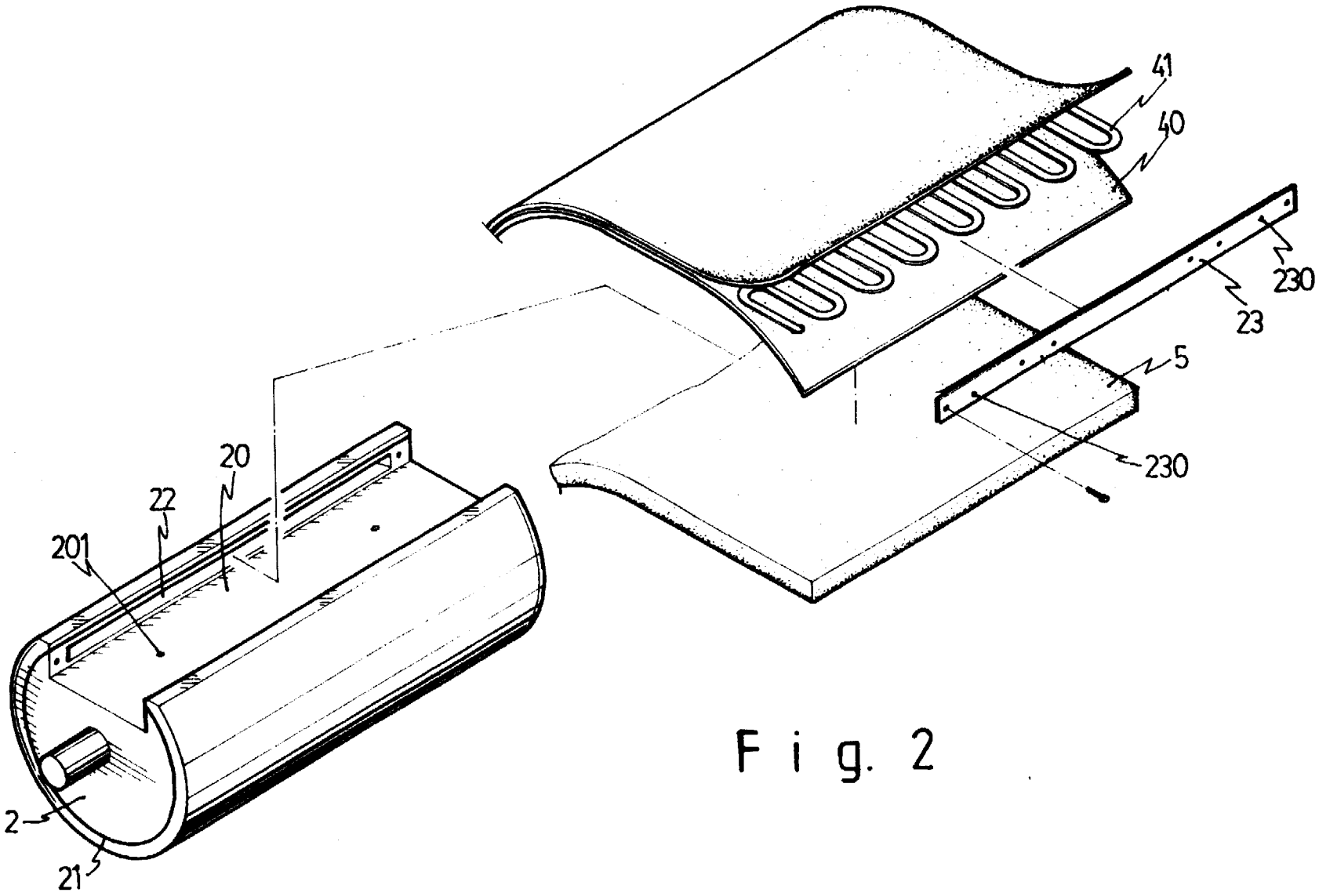
FIG. 2 is an exploded view of the hot press mechanism.
Figure 3:
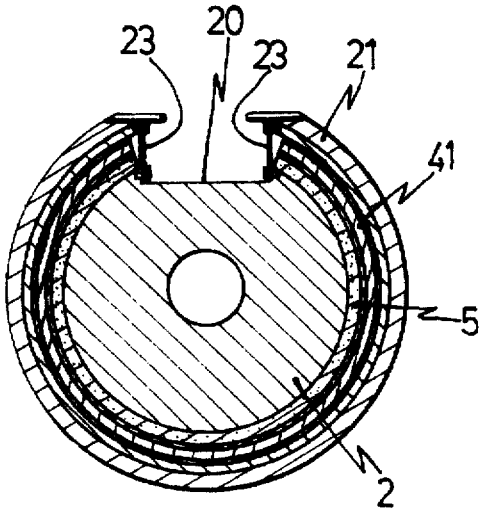
FIG. 3 is a cross sectional view taken along lines 3—3 of FIG. 1.

Referring to the drawings, and initially to FIGS. 1 to 3, a hot press mechanism for a printing machine in accordance with the present invention comprises a roller 2 including a longitudinal channel 20 formed in the peripheral portion and including a peripheral chamber 22 formed in the peripheral portion and communicating with the channel 20 for engaging with a heating plate 41. A tubular mold piece 21 is secured on the outer peripheral portion of the roller 2 and includes an outer peripheral surface formed with suitable pattern. Two protective layers 40 are engaged on the upper and the bottom of the heating plate 41, and a heat insulating layer 5 is engaged between the heating plate 41 and the roller 2 (FIG. 3) for allowing the heating plate 41 to heat the mold piece 21 only. The roller 2 includes a number of holes 201 for engaging with electric wires 202 which is coupled to the heating plate 41 for energizing the heating plate 41. The coupling of the electric wire to the heating plate 41 is conventional and is not related to the present invention and thus will not be described in further details. Two bars 23 are secured to the roller 2 for enclosing the chamber 22. The bars 23 each includes a number of holes 230 for engaging with the electric wires 202 (FIGS. 1 and 2). A number of fastening members 200 are secured in the channel 20 of the roller 2 for securing the mold piece 21 in place.

Figure 4:
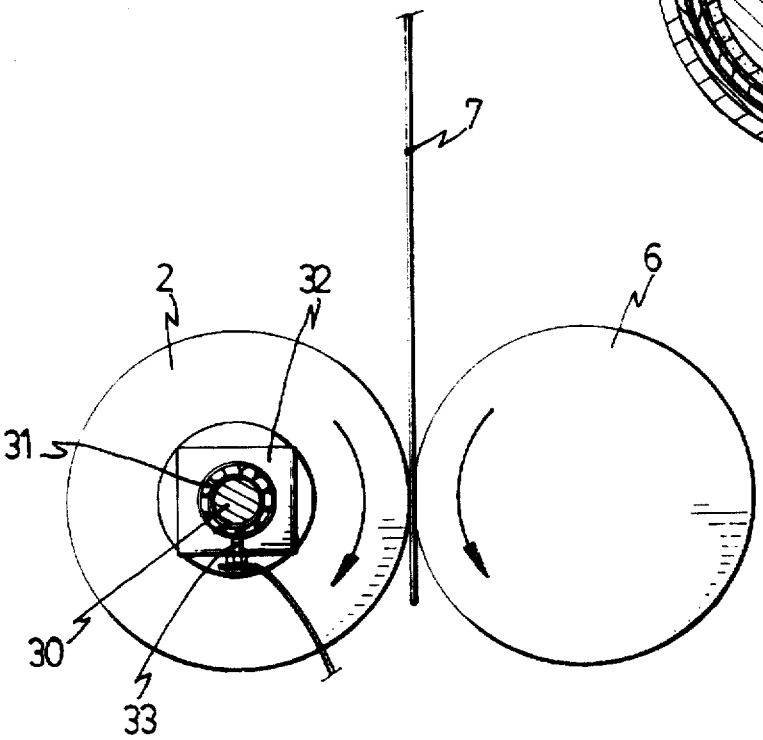
FIG. 4 is a schematic view illustrating the operation of the hot press mechanism.

As shown in FIGS. 1 and 4, a casing 32 is secured beside one end of the roller 2 and includes an electric transmission axle 30 rotatably engaged in the casing 32 by a bearing 31. An electric conductive member 33 couples an electric power to the bearing 31 and the axle 30 for supplying electric power to the heating plate 41. The electric coupling to the heating plate 41 is conventional and is not related to the present invention and thus will not be described in further details.

In operation, as shown in FIG. 4, another roller 6 is engaged with the mold piece 21 for engaging with a sheet material 7 between the mold piece 21 and the roller 6 and for allowing the mold piece 21 to heat and to transfer the pattern onto the sheet material 7.

Accordingly, the hot press mechanism includes only the outer mold piece that may be heated for saving much energy. The roller itself will not be heated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hot press mechanism for a printing machine, said hot press mechanism comprising:

a roller including a peripheral portion, a longitudinal channel formed in said peripheral portion, a peripheral chamber formed in said peripheral portion of said roller and communicating with said longitudinal channel, a mold piece engaged on said peripheral portion of said roller for engaging with a sheet material to be printed, means for securing said mold piece on said roller, a heating plate engaged in said peripheral chamber of said roller for heating said mold piece, said heating plate including an upper and a lower portions, two protective layers engaged on said upper and said lower portions of said heating plate, and a heat insulating layer engaged in said peripheral chamber of said roller and engaged between said roller and said heating plate for preventing said roller from being heated.

2. A hot press mechanism according to claim 1, wherein said securing means includes a pair of bars secured to said roller for enclosing said peripheral chamber and includes at least one fastener members for securing said mold piece to said roller.

* * * * *